US006119657A

United States Patent [19]

Stevens et al.

[11] Patent Number: 6,119,657

[45] Date of Patent: Sep. 19, 2000

[54] CONNECTOR

[75] Inventors: John William Stevens, Gillingham; Keith Graham Walker, Chatham; Martin John Ralph, Rainham; Alan Conway Green, Maidstone; Andrew Joseph John Drummond, Ashford; David Frederick Greenfield, Gillingham; Adrian Mark Greaney, Sittingbourne; Peter Francis Bradford, Sheerness, all of United Kingdom

[73] Assignee: Lucas Industries, United Kingdom

[21] Appl. No.: 08/896,251

[22] Filed: Jul. 17, 1997

[30] Foreign Application Priority Data

Jul. 20, 1996 [GB] United Kingdom ..... 9615305

[51] Int. Cl.[7] ..... F02M 37/04

[52] U.S. Cl. ..... 123/469; 123/470

[58] Field of Search ..... 123/468, 469, 123/470, 456; 285/305, 320

[56] References Cited

U.S. PATENT DOCUMENTS

| | | | |
|---|---|---|---|
| 4,240,385 | 12/1980 | Kulke | 123/470 |
| 5,135,264 | 8/1992 | Elliot-moore | 285/305 |
| 5,203,304 | 4/1993 | Hafner et al. | 123/456 |
| 5,301,647 | 4/1994 | Lorraine | 123/470 |
| 5,363,825 | 11/1994 | Becker | 123/456 |
| 5,666,922 | 9/1997 | Krimmer et al. | 285/320 |

FOREIGN PATENT DOCUMENTS

| | | |
|---|---|---|
| 2 198 062 | 3/1974 | France . |
| 2 444 813 | 7/1980 | France . |
| 41 31 537 | 4/1993 | Germany . |

*Primary Examiner*—Thomas N. Moulis
*Attorney, Agent, or Firm*—Fulbright & Jaworski L.L.P.

[57] ABSTRACT

A connector is disclosed which is intended for use with an injector. The connector comprises a projection defining an inlet passage sealed, in use, within a bore provided in the injector. The inlet passage communicates with at least one outlet passage. The connector further comprises at least one tooth received within a recess provided in the injector to secure the connector to the injector. The recess is conveniently defined by a body and nut forming part of the injector.

5 Claims, 1 Drawing Sheet

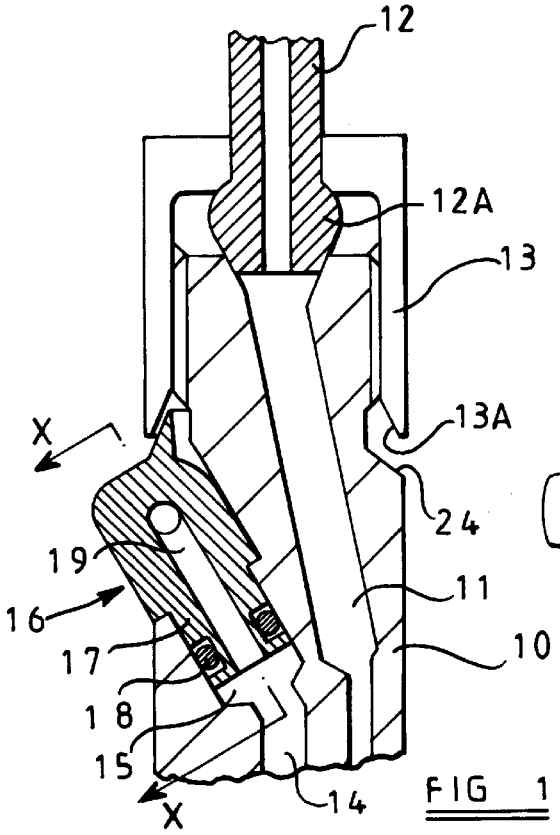
FIG 1
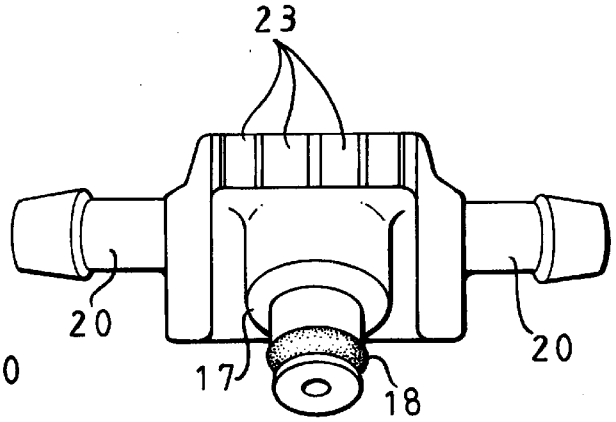
FIG 3
FIG 2
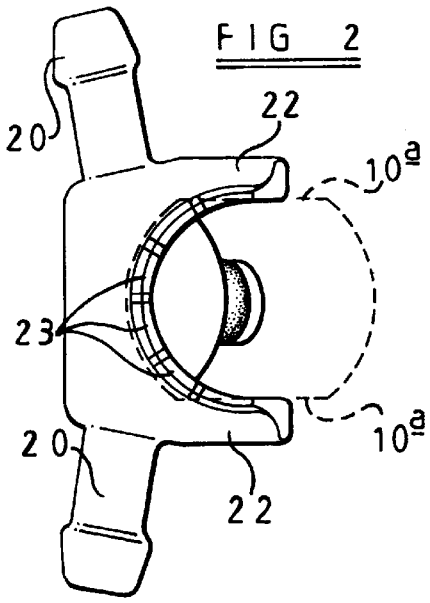
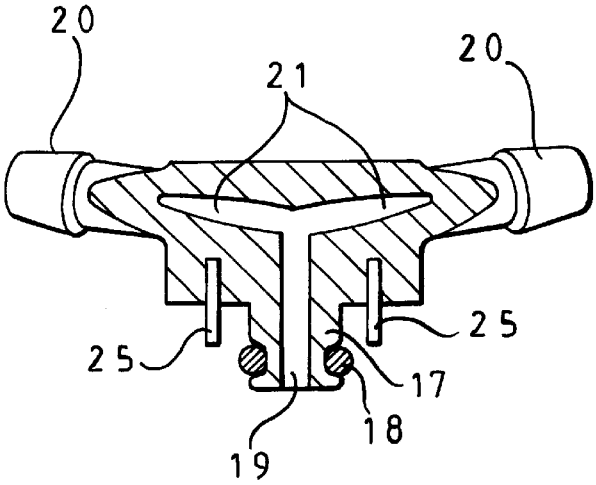
FIG 4

CONNECTOR

This invention relates to a connector for use in the return of fuel from an injector to a suitable low pressure fuel reservoir.

It is an object of the invention to provide a connector of relatively simple construction.

According to the present invention there is provided a connector comprising an inlet passage arranged to be sealingly connected to an injector, at least one outlet passage arranged to communicate with the inlet passage, and at least one tooth arranged to be received by a corresponding recess provided in an injector to secure the connector to the injector.

The invention further relates to an injector incorporating a connector of the type described hereinbefore, wherein the recess is defined by a body and a nut arranged to be secured to the body, the connector being positioned such that the or each tooth is located in a recess provided in the body prior to the nut being secured to the body.

The connector conveniently includes electrical connectors arranged to cooperate with terminals provided in the body whereby electrical connection to the injector may be facilitated.

The invention will further be described, by way of example, with reference to the accompanying drawings, in which:

FIG. 1 is a diagrammatic sectional view of part of an injector incorporating a connector in accordance with an embodiment of the invention;

FIG. 2 is a plan view of the connector of FIG. 1;

FIG. 3 is a side view of the connector of FIG. 1; and

FIG. 4 is a sectional view along the line X—X of FIG. 1.

FIG. 1 illustrates part of an injector and comprises a body 10 having a high pressure fuel flow passage 11 extending therethrough. A high pressure fuel supply line 12 is connected to an end of the passage 11, the supply line 12 including an enlarged diameter end region 12*a* which engages a cap nut 13 which is used to secure the supply line 12 to the body 10.

The body 10 further comprises a low pressure drain line 14 which opens into an enlarged diameter drain port 15 communicating with the exterior of the body 10 adjacent the lower end of the cap nut 13.

A connector 16 is received within the port 15, the connector 16 comprising an inlet spigot 17 including an annular recess within which an O-ring 18 is received to seal the spigot 17 to the body 10. The spigot 17 includes an axially extending passage 19 which communicates with the port 15 and hence with the low pressure drain line 14 provided in the body 10.

The connector 16 further includes a pair of outlet arms 20 each of which is provided with an axially extending passage 21 arranged to communicate with the passage 19 of the spigot 17. The end of each of the outlet arms 20 is provided with an enlarged diameter region, and in use a connecting pipe is forced over the enlarged diameter region of each of the arms 20 so as to provide a substantially fluid tight connection between the pipe and the arms 20.

In order to permit correct location of the connector 16 with respect to the body 10, the body 10 is provided with a pair of flat surfaces 10*a*, and as illustrated in FIG. 2, the connector 16 includes a pair of arms 22 which extend along the sides of the body 10, engaging the flat surfaces 10*a* thereof to correctly orientate the connector 16 with respect to the body 10.

In order to securely mount the connector 16 upon the body 10, the connector 16 includes a part circular collar which is provided with a plurality of slots such that the collar defines a plurality of projections or teeth 23. The body 10 is provided with an annular recess 24 located adjacent the lower end of the nut 13, and the lower end of the nut 13 is provided with an internal frustoconical surface 13*a*, the nut 13 and recess 24 defining a recess of suitable shape to retain the teeth 23 of the connector 16. With the teeth received within the recess as indicated in FIG. 1, it will be recognised that the connector 16 is securely attached to the injector, removal of the connector requiring either removal of the nut 13 from the body 11 or deformation of the connector 16.

During assembly of the injector, prior to securing the high pressure fuel line 12 and nut 13 to the body 10, the connector 16 is mounted such that the spigot 17 is received within the port 15, and the teeth 23 are received within the annular recess 24 provided in the body 10. The high pressure fuel line 12 and nut 13 are then secured to the body 10, the frustoconical end surface 13*a* of the nut 13 extending radially outwardly of the teeth 23 and deforming the teeth 23 to secure the teeth 23 within the recess, thus preventing removal of the teeth 23 from the recess 24 provided in the body 10.

As illustrated in FIG. 4, the connector 16 is further provided with electrical terminals 25 which are arranged to connect with corresponding terminals provided in the body 10 when the connector 16 is correctly mounted upon the injector. The terminals 25 are arranged to be connected to a controller of the injector so as to permit electrical control of the injector, for example if the injector includes an electromagnetically operable valve, the controller may be arranged to control the operation of the electromagnetically operated valve.

In use, several injectors will be provided, and the connectors 16 of each of the injectors a reconnected together by means of the pipes (not shown) referred to hereinbefore, the connector 16 of one of the injectors being connected to the low pressure drain. It will be appreciated that one of the connectors 16 will only require connection to one pipe, that connector 16 including a suitable plug to close one of the arms 20, or alternatively a different design of connector 16 may be used which only includes a single arm 20.

It will be appreciated that depending upon the choice of material used, a sufficiently good seal may be achieved between the connector and the body without using an O-ring.

We claim:

1. A connector for use with an injector, the connector comprising an inlet passage arranged to be sealingly connected to the injector, in use, at least one outlet passage communicating with the inlet passage, and at least one tooth arranged to be received, in use, within a recess provided in the injector to secure the connector to the injector, the connector being non-removable from the injector following connection thereto.

2. A connector as claimed in claim 1, wherein the connector includes a tubular projection defining the inlet passage, the projection being located, in use, within a bore provided in the injector.

3. A connector as claimed in claim 2, wherein the projection carries an O-ring to seal the projection to the injector.

4. A connector as claimed in claim 1, further comprising electrical connector terminals for cooperation with corresponding terminals of the injector.

5. In combination, an injector and a connector, the injector comprising a body and a nut secured to the body, the nut and body together defining a recess, the connector comprising an inlet passage sealingly connected to the injector, at least one outlet passage communicating with the inlet passage, and at least one tooth received within the recess to secure the connector to the injector.

* * * * *